US006708751B1

(12) United States Patent
Shulman

(10) Patent No.: US 6,708,751 B1
(45) Date of Patent: Mar. 23, 2004

(54) FLEXIBLE SCREEN PARTITIONS

(76) Inventor: Mildred Shulman, 15 Charles St., 3F, New York, NY (US) 10014

( * ) Notice: Subject to any disclaimer, the term of this patent is extended or adjusted under 35 U.S.C. 154(b) by 0 days.

(21) Appl. No.: 10/171,069

(22) Filed: Jun. 13, 2002

(51) Int. Cl.[7] ..... E06B 9/52
(52) U.S. Cl. ..... 160/372; 49/505
(58) Field of Search ..... 160/375, 371, 160/372, 374; 49/505

(56) References Cited

U.S. PATENT DOCUMENTS 1,682,605 A * 8/1928 Dicks ..... 454/217
2,440,468 A * 4/1948 Gerken ..... 454/221
3,553,891 A * 1/1971 Casebolt et al. ..... 49/505
5,524,407 A * 6/1996 Ricard et al. ..... 52/473
5,845,439 A * 12/1998 Hendley ..... 52/204.1
6,044,892 A * 4/2000 Epstein ..... 160/380
6,108,997 A * 8/2000 Blais et al. ..... 52/656.7
6,125,581 A * 10/2000 Grossman ..... 49/74.1
2001/0034169 A1 * 10/2001 Goetz et al. ..... 442/6

* cited by examiner

*Primary Examiner*—Blair M. Johnson
(74) *Attorney, Agent, or Firm*—Collard & Roe, P.C.

(57) ABSTRACT

A flexible screen partition that has a plastic frame with top, bottom, left, and right sides surrounding an open interior space. The plastic frame is preferably rectangular and flexible. A wire mesh segment covers the entire interior space of the plastic frame. The wire mesh segment has top, bottom, left, and right edges that are fused with the respective sides of the plastic frame. The plastic frame has at least one receiving aperture on both its left and right sides. The flexible screen partition also includes at least one extension piece. This extension piece has at least one insertable projection on one of its sides. The insertable projection is insertable into a receiving aperture on the plastic frame. An extension piece is attached to either the right or left side of the plastic frame when the plastic frame is not wide enough to cover the area of its intended use.

5 Claims, 2 Drawing Sheets

FLEXIBLE SCREEN PARTITIONS

BACKGROUND

The invention relates to an improved screen assembly, specifically for windows and vents. A window screen consists of mesh, or screening; supported by a lightweight rectangular frame. The frame includes four essentially straight segments which are connected at their ends to form the corners of the frame. Screen frames ordinarily slide vertically or horizontally along tracks on the outer edges of window jambs.

Frames must be lightweight and low cost to be competitively marketed. Assembly processes can be labor intensive adding to the cost of the frames.

SUMMARY

The invention relates to a flexible screen partition. The flexible screen partition is snapped into window frames or adhered over household vents. The partition has a plastic frame which has top, bottom, left, and right sides surrounding an open interior space. The plastic frame is preferably rectangular and flexible. A wire mesh segment fills the entire open interior space of the plastic frame. The wire mesh segment has top, bottom, left, and right edges that are fused with the respective sides of the plastic frame. The plastic frame has at least one receiving aperture on both its left and right sides.

The plastic frame can be coupled to extension pieces. The extension pieces have at least one insertable projection on one of its sides. The projections are insertable into the receiving apertures on the plastic frame coupling the two elements. The extension piece is attached to the right or left side of the plastic frame when the plastic frame is not wide enough to cover the area of its intended use.

The plastic frame, and the extension piece if needed, are placed in a window or over a vent. The flexible screen partition permits air to flow through the interior space of the frame but hampers the passing of larger objects.

The flexible screen partition is formed in an injection molding process. A wire mesh segment is cut to a size slightly larger than the intended area of the open interior of the frame. The wire mesh segment is then placed in an injection molding machine where the plastic frame is molded at its perimeter. Because the wire mesh segment is larger than the area of the open interior of the screen, the four edges of the wire mesh segment are within the injection molding and are fused with the newly formed plastic frame, permanently coupling the wire mesh and plastic frame. The extension pieces are formed in a similar injection molding process.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION

Figure 1:
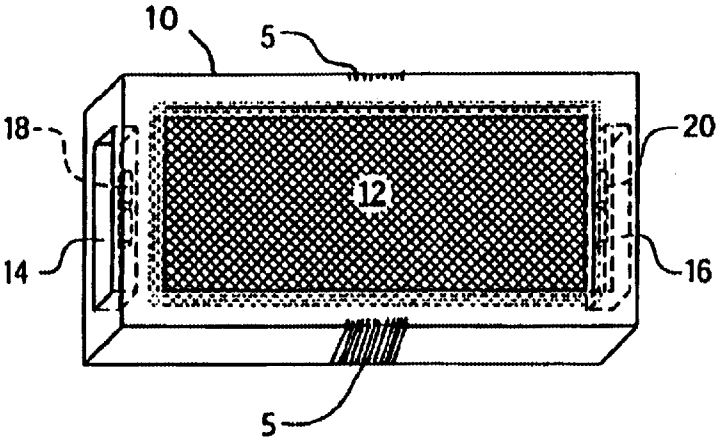
FIG. 1 is a perspective view of the flexible screen partition for a window.

Referring now in detail to the drawings, FIG. 1 shows a perspective view of a flexible screen partition 1 for a window. Flexible screen partition 1 has a plastic frame 10 that has four sides and is substantially rectangular. Plastic frame 10 is also flexible. Flex segments 5 are built into the plastic frame so that it may be slightly compressed to fit into a window frame. They assist in exerting an outward force on the window frame, keeping flexible screen partition 1 in place. A wire mesh segment 12 fills the open interior space of plastic frame 10. Wire mesh segment 12 has four edges that extend into plastic frame 10 and are permanently fused with plastic frame 10. Plastic frame 10 has at least one receiving aperture 14 on its right and left sides. Inside of receiving apertures 14 are internal mechanisms 18, also formed in the injection molding process.

Figure 2:
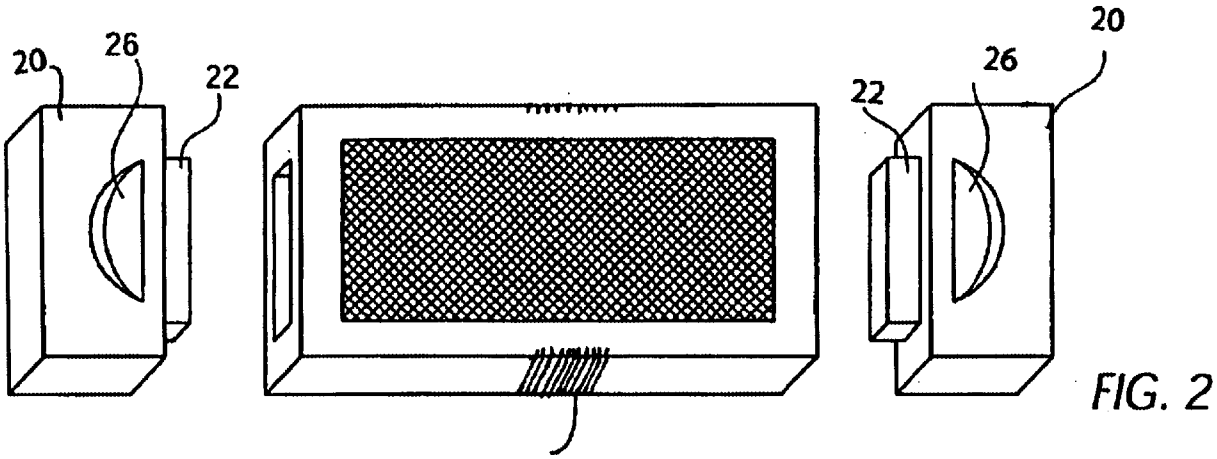
FIG. 2 is an exploded view of the flexible screen partition for a window with extension pieces.

FIG. 2 shows flexible screen partition 1 with extension pieces 20 on either side of plastic frame 10. Extension pieces 20 have insertable projections 22. Insertable projections 22 are inserted into receiving apertures 14 and held in place by internal mechanisms 18. Internal mechanisms 18 hold insertable projections 22 in a snap-in lock fashion, much like that of a car seat. Extension pieces 20 are coupled to plastic frame 10 when the width of flexible screen partition 1 must be increased. Extension pieces 20 also have indentations 26 providing an area to grip when extension pieces 20 are connected or disconnected from plastic frame 10.

Figure 3:
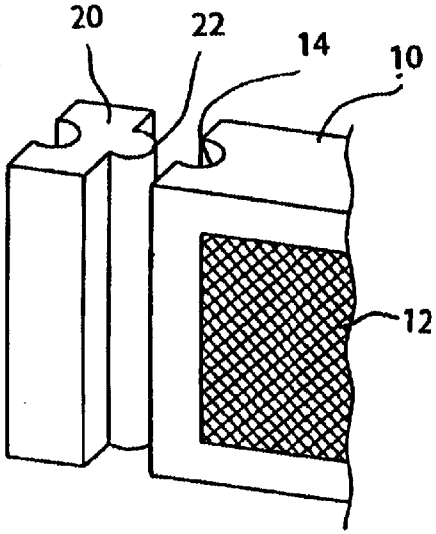
FIG. 3 is a partial exploded view of the flexible screen partition for a window with a dovetail connector.

FIG. 3 shows an embodiment of flexible screen partition 1 where insertable projections 22 and receiving apertures 14 are shaped for a dove-tail connection.

In use, flexible screen partition 1 is snapped into an open window frame when the window is open. The flexibility of plastic frame 10 allows flexible screen partition 1 to snap into the window frame. Flexible screen partition 1 is held in place by the friction between plastic frame 10 and the window frame and the window that is closed upon it.

Figure 4:
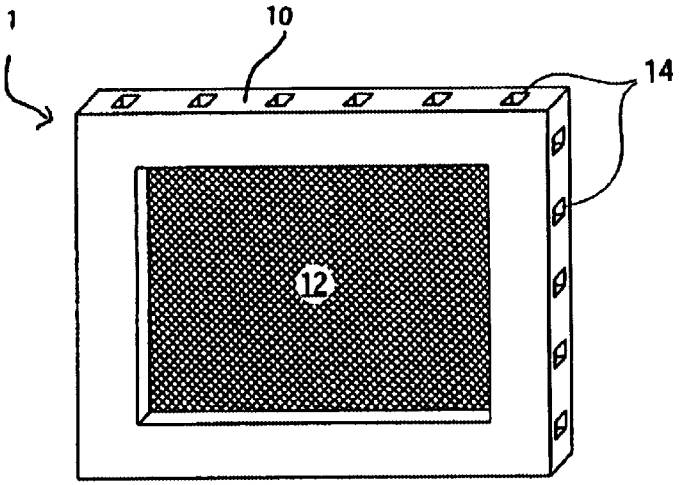
FIG. 4 is a front perspective view of the flexible screen partition for a vent.

FIG. 4 shows a second embodiment of the present invention where flexible screen partition 1 is meant to cover a ventilation outlet or other household hole. Plastic frame 10 surrounds wire mesh segment 12. Wire mesh segment 12 is permanently fused to plastic frame 10. Receiving apertures 14 are shown on the sides of plastic frame 10.

Figure 5:
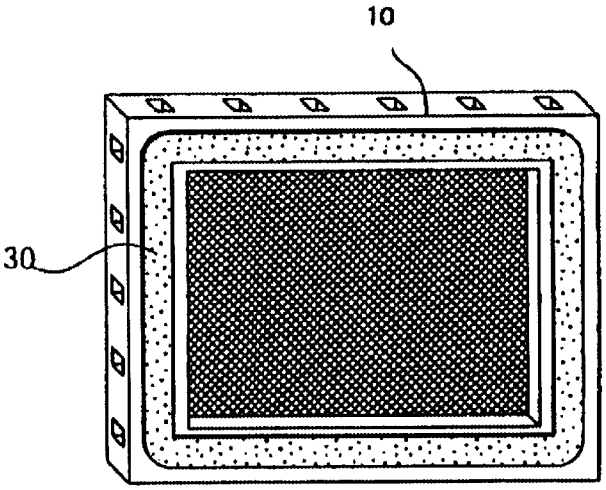
FIG. 5 is a back perspective view of the flexible screen partition for a vent.

FIG. 5 shows a back view of flexible screen partition 1 for a ventilation outlet. An adhesive 30 is added to the back of plastic frame 10. Adhesive 30 holds plastic frame 10 to most dry surfaces, permitting flexible screen partition 1 to quickly cover holes.

Figure 7:
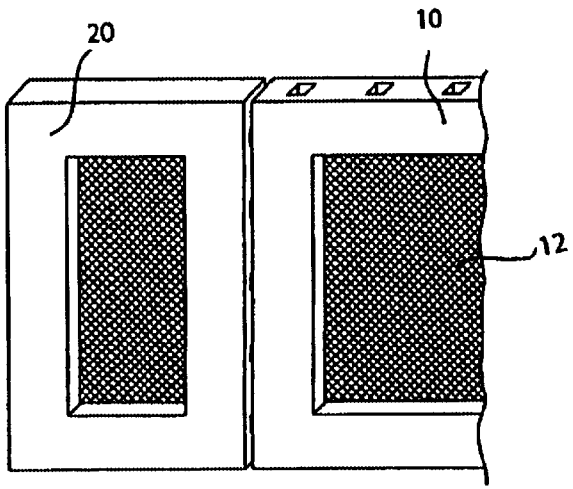
FIG. 7 shows the flexible screen partition and the extension piece for a vent in the coupled position.
Figure 6:
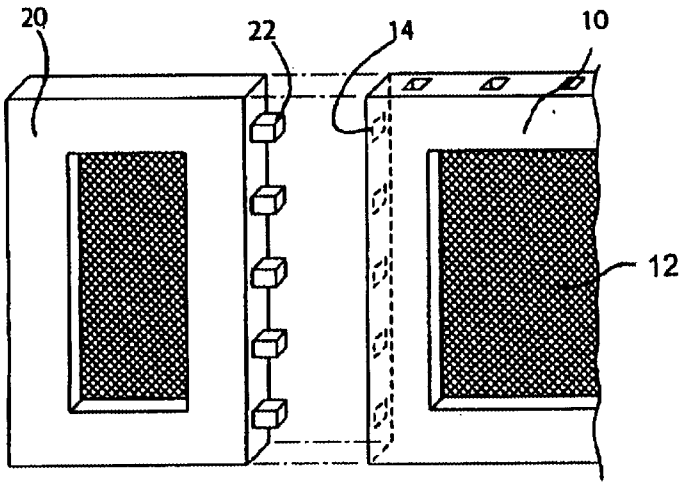
FIG. 6 is an exploded view of the flexible screen partition and the extension piece for a vent.

FIG. 6 shows a partial exploded view of flexible screen partition 1 with extension piece 20. Extension piece 20 has insertable projections 22 that can be received by receiving apertures 14. FIG. 7 shows plastic frame 10 and connection segment 20 in a coupled position. Extension piece 20 may be comprised of a plastic frame and an interior wire mesh segment.

Flexible screen partition 1 is formed in an injection molding process. Wire mesh segment 12 is cut to a size slightly larger than the intended area of the open interior of plastic frame 10. Wire mesh segment 12 is then placed in an injection molding machine where plastic frame 10 is molded along the perimeter of wire mesh segment 12. Since wire mesh segment 12 is larger than the open interior space of plastic frame 10, the four edges of wire mesh segment 12 are within the injection molding and fused with plastic frame 10, permanently coupling wire mesh segment 12 to plastic frame 10. Extension pieces 20 are formed in a similar injection molding process.

Accordingly, while at least one embodiment of the present invention has been shown and described, it is obvious that many changes and modifications may be made thereunto without departing from the spirit and scope of the invention.

What is claimed is:

1. A flexible screen partition comprising:

a plastic frame having a top side, a bottom side, a left side and a right side surrounding an open interior space, wherein said plastic frame is substantially rectangular and flexible;

a wire mesh segment having a top edge, a bottom edge, a left edge, and a right edge, wherein said edges are fused with said respective sides of said plastic frame, and wherein said wire mesh segment covers all of said open interior space of said plastic frame;

at least one receiving aperture disposed in at least one of said sides of said plastic frame;

at least one extension piece having a front, a back, and four sides, wherein said at least one extension piece is comprised of a frame and a screen and wherein said at least one extension piece is detachably coupled to said plastic frame, and wherein said at least one extension piece increases the overall length of the flexible screen partition; and at least one insertable projection disposed on one of said four sides of said at least one extension piece, wherein said at least one insertable projection is connected into said at least one receiving aperture, detachably coupling said at least one extension piece to said plastic frame;

wherein the flexible screen partition seals closed an orifice and permits air to pass through said wire mesh in said interior of said plastic frame, but hampers the passing of larger objects.

2. The flexible screen partition of claim 1, further comprising flex segments that are built into said top and bottom sides of said frame, where said flex segments allow said frame to compress when force is applied from said left and right sides of said frame.

3. The flexible screen partition of claim 1, further comprising an internal mechanism disposed in said at least one receiving aperture of said plastic frame, wherein said internal mechanism acts as a snap-in look for said at least one receiving aperture of said plastic frame and said at least one insertable projection of said at least one extension piece.

4. The flexible screen partition of claim 1, further comprising indentations disposed on said at least one extension piece wherein said indentations provide an area to grip when said at least one extension piece is connected and disconnected from said plastic frame.

5. The flexible screen partition of claim 1, wherein a back side of said plastic frame is coated with an adhesive so that said plastic frame can adhere to a solid surface.

* * * * *